US010130185B2

(12) United States Patent
Sigmon et al.

(10) Patent No.: US 10,130,185 B2
(45) Date of Patent: Nov. 20, 2018

(54) ADJUSTABLE LUMBAR SUPPORT FOR UPHOLSTERY FURNITURE

(71) Applicant: L&P PROPERTY MANAGEMENT COMPANY, South Gate, CA (US)

(72) Inventors: Allen R. Sigmon, High Point, NC (US); Brent J. Ackermann, Pittsboro, NC (US); Larry I. Bullard, Winston-Salem, NC (US); Jason H. Carr, Thaxton, MS (US)

(73) Assignee: L&P Property Management Company, South Gate, CA (US)

( * ) Notice: Subject to any disclaimer, the term of this patent is extended or adjusted under 35 U.S.C. 154(b) by 193 days.

(21) Appl. No.: 15/184,260

(22) Filed: Jun. 16, 2016

(65) Prior Publication Data

US 2017/0215590 A1 Aug. 3, 2017

Related U.S. Application Data

(63) Continuation-in-part of application No. 15/012,949, filed on Feb. 2, 2016.

(51) Int. Cl.
*A47C 7/20* (2006.01)
*A47C 7/46* (2006.01)

(52) U.S. Cl.
CPC ..... *A47C 7/462* (2013.01)

(58) Field of Classification Search
CPC ..... A47C 7/462
USPC ..... 297/284.4, 284.7
See application file for complete search history.

(56) References Cited

U.S. PATENT DOCUMENTS

| | | | | |
|---|---|---|---|---|
| 1,922,418 A * | 8/1933 | Conant | A47C 7/425 248/407 |
| 4,183,533 A | 1/1980 | Arndt et al. | |
| 4,313,637 A | 2/1982 | Barley | |
| 4,531,779 A | 7/1985 | Hashimoto | |
| 5,286,087 A * | 2/1994 | Elton | B60N 2/66 297/284.1 |
| 6,402,246 B1 | 6/2002 | Mundell | |

(Continued)

FOREIGN PATENT DOCUMENTS

| | | |
|---|---|---|
| CA | 1125159 A | 6/1982 |
| EP | 2039270 A1 | 3/2009 |

OTHER PUBLICATIONS

International Search Report and Written Opinion dated Feb. 2, 2017 in International Application No. PCT/US17/16203, 9 pages.
Extended European Search Report dated Apr. 4, 2017 in European Patent Application No. 16205016.5, 7 pages.

(Continued)

*Primary Examiner* — Syed A Islam
(74) *Attorney, Agent, or Firm* — Shook, Hardy & Bacon, L.L.P.

(57) ABSTRACT

An adjustable lumbar support mechanism and motion upholstery furniture having the same are provided. The adjustable lumbar support mechanism includes a lumbar support member that is coupled to a lumbar support link. The lumbar support link is coupled to a lumbar support mounting plate. An actuating mechanism is coupled to the lumbar support link such that when an extendable shaft of the actuating mechanism shifts from a retracted to an extended configuration, the lumbar support member rotates away from a back portion of a seat back and towards the seat to provide lumbar support to an occupant sitting in the furniture.

20 Claims, 8 Drawing Sheets

(56) References Cited

U.S. PATENT DOCUMENTS

| | | | | |
|---|---|---|---|---|
| 7,083,233 | B2 * | 8/2006 | Massara | B60N 2/66 297/284.4 |
| 8,622,468 | B2 | 1/2014 | Masuda et al. | |
| 2003/0085600 | A1 | 5/2003 | Mori | |
| 2003/0178882 | A1 | 9/2003 | Schmitz et al. | |
| 2003/0184139 | A1 | 10/2003 | Sloan, Jr. | |
| 2007/0106188 | A1 | 5/2007 | Walker | |
| 2009/0079245 | A1 | 3/2009 | Marcantoni et al. | |
| 2009/0218863 | A1 | 9/2009 | LaPointe et al. | |
| 2013/0145553 | A1 | 6/2013 | Shih | |
| 2013/0334854 | A1 | 12/2013 | LaPointe et al. | |
| 2014/0070583 | A1 | 3/2014 | McMillen et al. | |
| 2016/0227933 | A1 | 8/2016 | Donovan | |
| 2016/0367033 | A1 | 12/2016 | Sigmon et al. | |

OTHER PUBLICATIONS

International Search Report and Written Opinion dated Apr. 6, 2017 in International Patent Application No. PCT/US2017/014146, 8 pages.

Non-Final Office Action dated Jun. 9, 2017 in U.S. Appl. No. 15/012,949, 8 pages.

Final Office Action dated Dec. 11, 2017 in U.S. Appl. No. 15/012,949, 7 pages.

International Preliminary Report on Patentability dated Aug. 16, 2018 in International Patent Application No. PCT/US2017/016203, 7 pages.

International Preliminary Report on Patentability dated Aug. 16, 2018 in International Patent Application No. PCT/US2017/014146, 6 pages.

* cited by examiner

ADJUSTABLE LUMBAR SUPPORT FOR UPHOLSTERY FURNITURE

RELATED APPLICATIONS

This application is a continuation-in-part of U.S. patent application Ser. No. 15/012,949, filed Feb. 2, 2016, which is hereby incorporated by reference in its entirety.

TECHNICAL FIELD

Aspects of this disclosure relate generally to upholstery furniture. More particularly, this disclosure includes aspects relating to an adjustable lumbar support for use in motion upholstery furniture.

BACKGROUND

Certain current lumbar support systems utilized in various chairs, seats, or other furniture can provide lumbar support mechanically or with an air bladder. However, such current lumbar support systems are not strong enough to provide adequate lumbar support that can be felt by an occupant through thick padding often found on a variety of upholstered furniture. Further, some current lumbar support systems only provide lumbar support across a small portion of a lower region of a seat back, which can lead to occupant discomfort. What is needed is a lumbar support mechanism for use on upholstered furniture that can provide enhanced lumbar support across a substantial portion of a lower or lumbar region of a seat back.

BRIEF SUMMARY

The present disclosure generally relates to an adjustable lumbar support mechanism for upholstered furniture. The lumbar support mechanism can include a lumbar support member coupled, via at least one lumbar support link, to an actuating mechanism. Upon extension of an extendable shaft associated with the actuating mechanism, the lumbar support member can shift from a retracted position to an extended position, where the lumbar support member is at least partly positioned more towards the seat in order to provide lumbar support for an occupant.

Accordingly, in one aspect, an adjustable lumbar support mechanism is provided. The adjustable lumbar support mechanism can provide lumbar support in a seating unit having a seat and a seat back having a back frame, the back frame having opposing first and second side frame members, and opposing top and bottom frame members, the bottom frame member being positioned adjacent the seat. The adjustable lumbar support mechanism includes a lumbar support member, the lumbar support member having opposing first and second ends; and at least one lumbar support link fixedly coupled to one of the first and second ends of the lumbar support member. The adjustable lumbar support mechanism also includes at least one lumbar mounting plate pivotably coupled to the at least one lumbar support link at a mounting plate pivot point, and one or more actuating mechanisms. Each of the one or more actuating mechanisms includes an extendable shaft pivotably coupled to the at least one lumbar support link at an extendable shaft pivot point, where when the extendable shaft is shifted from a retracted position to an extended position, the at least one lumbar support link is configured to rotate relative to the at least one lumbar mounting plate thereby positioning at least a portion of the lumbar support member away from the back frame and towards the seat.

In another aspect, a residential furniture seating unit is provided. The residential furniture seating unit includes a seat spaced above a surface on which the seating unit rests, and a seat back extending upwardly from the seat adjacent a rear portion of the seat. The seat back includes a seat back frame having opposing first and second side frame members, and opposing top and bottom frame members, the bottom frame member being positioned adjacent the seat. The residential furniture seating unit also includes an adjustable lumbar support mechanism. The adjustable lumbar support mechanism includes a lumbar support member, the lumbar support member having opposing first and second ends; and at least one lumbar support link fixedly coupled to one of the first and second ends of the lumbar support member. The adjustable lumbar support mechanism also includes at least one lumbar mounting plate pivotably coupled to the at least one lumbar support link at a mounting plate pivot point; and one or more actuating mechanisms. Each of the one or more actuating mechanisms comprises an extendable shaft pivotably coupled to the at least one lumbar support link at an extendable shaft pivot point, where when the extendable shaft is shifted from a retracted position to an extended position, the at least one lumbar support link is configured to rotate relative to the at least one lumbar mounting plate thereby positioning at least a portion of the lumbar support member away from the seat back frame and towards the seat.

In yet another aspect, an adjustable lumbar support mechanism is provided. The adjustable lumbar support mechanism provides lumbar support in a seating unit having a seat and a seat back having a back frame, the back frame having opposing first and second side frame members, and opposing top and bottom frame members, the bottom frame member being positioned adjacent the seat. The adjustable lumbar support mechanism includes a lumbar support member. The lumbar support member has opposing first and second ends and an exterior surface extending between the first and second ends, where the exterior surface has a front portion and an opposing back portion. The adjustable lumbar support mechanism also includes at least one lumbar support link fixedly coupled to the lumbar support member, and at least one lumbar mounting plate pivotably coupled to the at least one lumbar support link at a mounting plate pivot point. Further, the adjustable lumbar support mechanism includes one or more actuating mechanisms. Each of the one or more actuating mechanisms includes an extendable shaft pivotably coupled to the at least one lumbar support link at an extendable shaft pivot point, where when the extendable shaft is shifted from a retracted position to an extended position, the at least one lumbar support link is configured to rotate relative to the at least one lumbar mounting plate thereby positioning at least the front portion of the exterior surface of the lumbar support member away from the back frame and towards the seat.

In another aspect, a residential furniture seating unit is provided. The residential furniture seating unit includes a seat spaced above a surface on which the seating unit rests. The seating unit also includes a seat back extending upwardly from the seat adjacent a rear portion of the seat. The seat back includes a seat back frame having opposing first and second side frame members, and opposing top and bottom frame members, the bottom frame member being positioned adjacent the seat. The seating unit further includes an adjustable lumbar support mechanism. The adjustable lumbar support mechanism includes a lumbar support member, the lumbar support member having opposing first and second ends and an exterior surface extending between the first and second ends, where the exterior surface has a front portion and an opposing back portion. The adjustable lumbar support mechanism also includes at least one lumbar support link fixedly coupled to the lumbar support member, and at least one lumbar mounting plate pivotably coupled to the at least one lumbar support link at a mounting plate pivot point. The adjustable lumbar support mechanism further includes one or more actuating mechanisms, where each of the one or more actuating mechanisms includes an extendable shaft pivotably coupled to the at least one lumbar support link at an extendable shaft pivot point, where when the extendable shaft is shifted from a retracted position to an extended position, the at least one lumbar support link is configured to rotate relative to the at least one lumbar mounting plate thereby positioning at least the front portion of the exterior surface of the lumbar support member away from the back frame and towards the seat.

BRIEF DESCRIPTION OF THE SEVERAL VIEWS OF THE DRAWINGS

The accompanying drawings form a part of the specification, are to be read in conjunction therewith, and are incorporated by reference in their entirety. In the drawings.

DETAILED DESCRIPTION OF THE INVENTION

The subject matter of aspects of the present invention is described with specificity herein to meet statutory requirements. However, the description itself is not intended to limit the scope of this patent. Rather, the inventor has contemplated that the claimed subject matter might also be embodied in other ways, to include different elements or combinations of elements similar to the ones described in this document, in conjunction with other present or future technologies.

Throughout this disclosure various components are described that are pivotably interconnected. The pivotable couplings (illustrated as pivot points in the figures and described herein) between these components can take a variety of configurations, such as pivot pins, bearings, traditional mounting hardware, rivets, bolt and nut combinations, or any other suitable fasteners which are well known in the furniture-manufacturing industry. Also, the shapes of the links and the brackets may vary as desired, as may the locations of certain pivot points, unless otherwise indicated.

As discussed above, the present invention relates broadly to upholstery furniture designed to support a user's body in an essentially seated disposition. One category of this furniture is motion upholstery furniture, including recliners, incliners, sofas, love seats, sectionals, theater seating, traditional chairs, and chairs with a moveable seat portion, such furniture pieces being referred to herein generally as "seating units."

Figure 1:
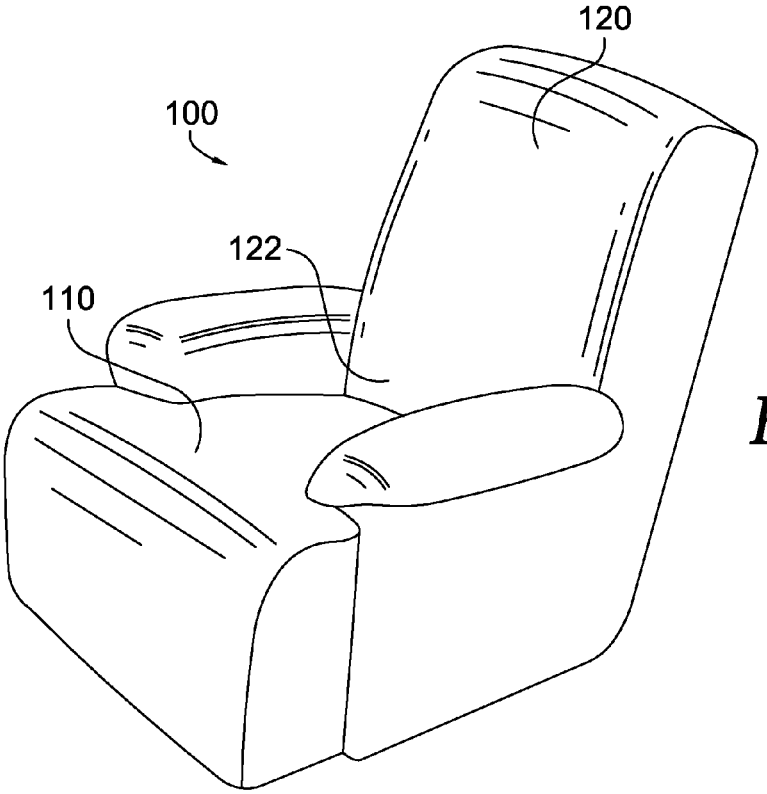
FIG. 1 is a front perspective view of a chair in a position with an adjustable lumbar support in a retracted position in accordance with an aspect of the present invention.
Figure 2:
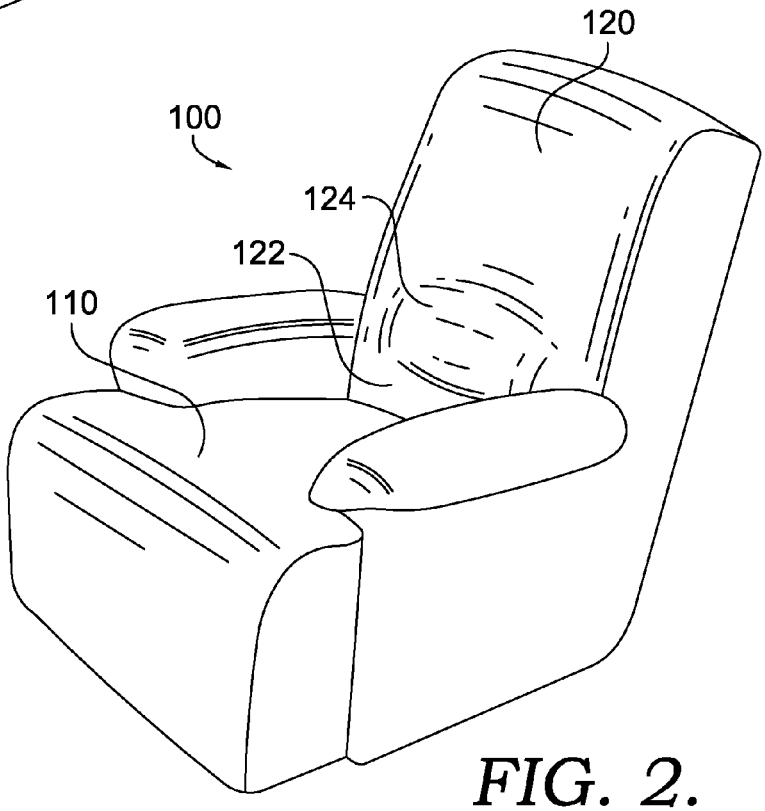
FIG. 2 is a view similar to FIG. 1, in a position with an adjustable lumbar support in an extended position in accordance with an aspect of the present invention.

An exemplary seating unit 100 is shown in FIGS. 1 and 2. The seating unit 100 includes a seat 110 and a back 120. In various aspects, near the seat 110 in the lower area 122 of the back 120 is a lumbar area 124. In one or more aspects, the lumbar support mechanisms described herein can provide lumbar support to the lumbar area 124 of the seating unit 100.

Figure 4:
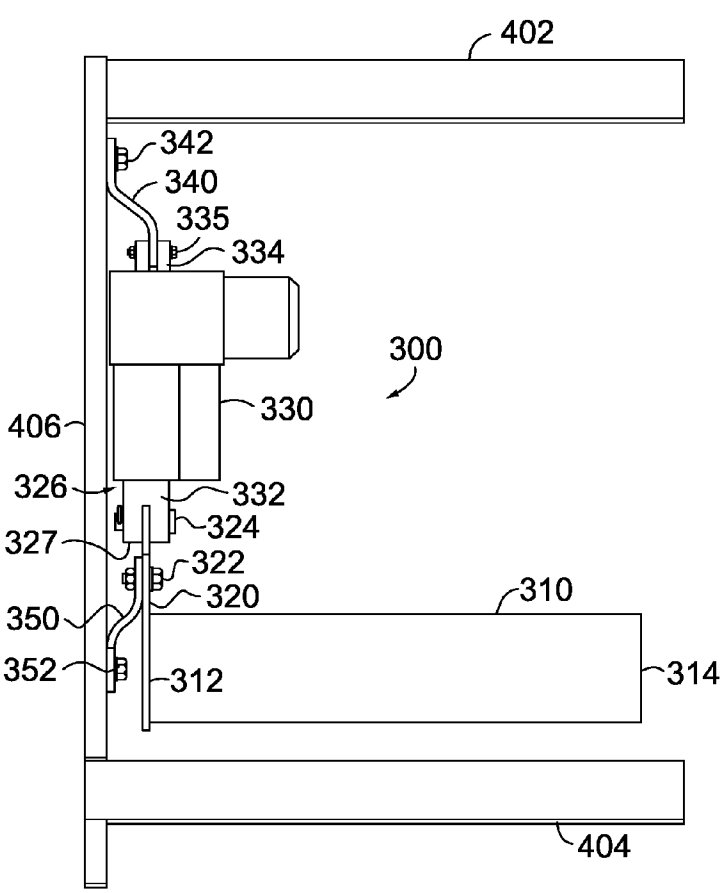
FIG. 4 is a front view of the adjustable lumbar support mechanism depicted in FIG. 3, in accordance with an aspect of the present invention.
Figure 3:
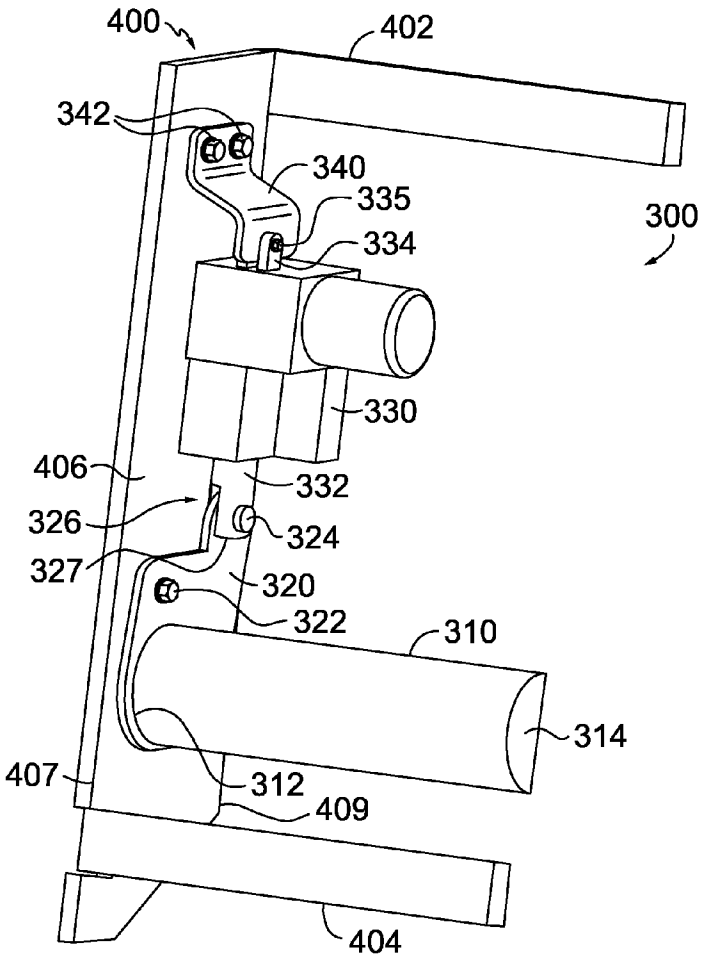
FIG. 3 is a front perspective view of an adjustable lumbar support mechanism in a retracted position and showing portions of the chair back frame in accordance with an aspect of the present invention.

Turning now to FIGS. 3 and 4 a seat back 120 is depicted without the finishing foam, fabric, etc., to reveal details of construction and position of the underlying adjustable lumbar support mechanism 300. As can be seen in FIGS. 3 and 4, various components of the lumbar support mechanism 300 are coupled to a side frame member 406 of the seat back frame 400. The seat back frame 400 depicted in the figures is merely exemplary and it should be understood that the seat back frame 400 could take on any number of different constructions.

In certain aspects, such as that depicted in FIGS. 3 and 4, the adjustable lumbar support mechanism 300 is positioned, at least partly or entirely, between opposing top and bottom seat back frame members 402 and 404, respectively. It is appreciated that, in the seating unit 100, the bottom seat back frame member 404 would be positioned adjacent the seat 110, while the top seat back frame member 402 would be positioned near a head rest region of the seat back 120.

In certain aspects, the adjustable lumbar support mechanism is designed to provide an economical lumbar support mechanism 300 that can be utilized in a wide variety of motion upholstery furniture. In such aspects, the adjustable lumbar support mechanism 300 can include minimal components in order to keep manufacturing costs down and to provide a compact support mechanism that can be utilized in a wide variety of motion upholstery furniture. Accordingly, in one or more aspects, the adjustable lumbar support mechanism 300 comprises, consists essentially of, or consists of a lumbar support member 310, one or more lumbar support links 320, an actuating mechanism 330, an actuator mounting plate 340, and one or more lumbar support member mounting plates 350.

In certain aspects, the lumbar support member 310 can include opposing ends 312 and 314. In one or more aspects, the end 312 of the lumbar support member 310 can be coupled, e.g., fixedly coupled, to the lumbar support link 320. In various aspects, the lumbar support link 320 and the end 312 of the lumbar support member 310 can be fixedly coupled using any conventional techniques, such as by the use of rivets, bolts, screws, or welding.

In one or more aspects, the lumbar support link 320 can be coupled, e.g., pivotably coupled, to the lumbar support member mounting plate 350 at a mounting plate pivot point 322. In certain aspects, the lumbar support member mounting plate 350 may be fixedly coupled to a portion of the side frame member 406 via one or more connectors 352. As best seen in FIG. 3, the mounting plate pivot point 322 is positioned closer to the front portion 407 than the back portion 409 of the side frame member 406. In certain aspects, the mounting plate pivot point 322 is positioned closer to the top frame member 402 than a portion of, or all of, the lumbar support member 310. In the same or alternative aspects, a portion of, or all of, the lumbar support member 310 is positioned closer to the bottom frame member 404 than the mounting plate pivot point 322.

As discussed above, the lumbar support mechanism 300 can include an actuating mechanism 330. The actuating mechanism 330 can be any type of actuating mechanism commonly used in the furniture-manufacturing industry. In one aspect, the actuating mechanism 330 can include an extendable shaft 332. The extendable shaft 332 can be coupled, e.g., pivotably coupled, to the lumbar support link 320 at an extendable shaft pivot point 324. In certain aspects, the extendable shaft pivot point 324 can be positioned adjacent the end 326 of the extendable shaft 332. In one or more aspects, the end 326 of the extendable shaft 322 can include a clevis 327 that can be used for pivotably coupling the lumbar support link 320 the extendable shaft 332.

In various aspects, the extendable shaft 332 and the extendable shaft pivot point 324 can be positioned closer to the back portion 409 than the front portion 407 of the frame member 406. In the same or alternative aspects, the extendable shaft pivot point 324 can be positioned closer to the back portion 409 of the frame member 406 than the mounting plate pivot point 322, and/or the mounting plate pivot point 322 can be positioned closer to the front portion 407 of the frame member 406 than the extendable shaft pivot point 324. In certain aspects, this positioning of the extendable shaft 332, the extendable shaft pivot point 324, the lumbar support member 310, and/or the mounting plate pivot point 322 can maximize the force generated by the extension of the extendable shaft 332 in order to provide adequate force to move the lumbar support member 310 forward towards the seat 110 and up against any upholstery and/or padding on the back 120 of the seating unit 100 to provide lumbar support to a chair occupant.

In certain embodiments, the actuating mechanism 330 can be coupled to the frame 400 of the seating unit 100 via an actuator mounting plate 340. The actuator mounting plate 340 can be fixedly coupled to the frame member 406 via one or more connectors 342. The actuating mechanism 330 can be coupled to the actuator mounting plate 340 in any manner. In certain aspects, the actuating mechanism 330 can include a clevis 334 for coupling to the actuator mounting plate 340. In such aspects, the clevis 334 can allow for at least a portion of the actuating mechanism 330 to pivot relative to the actuator mounting plate 340 at an actuator pivot point 335.

While not shown in the figures, the actuating mechanism 330 may be coupled to an activator, such as a remote control or a switch, for use by the chair occupant. Such an activator can control the retraction and extension of the extendable shaft 332 of the actuating mechanism to a position desired by the chair occupant.

Figure 5:
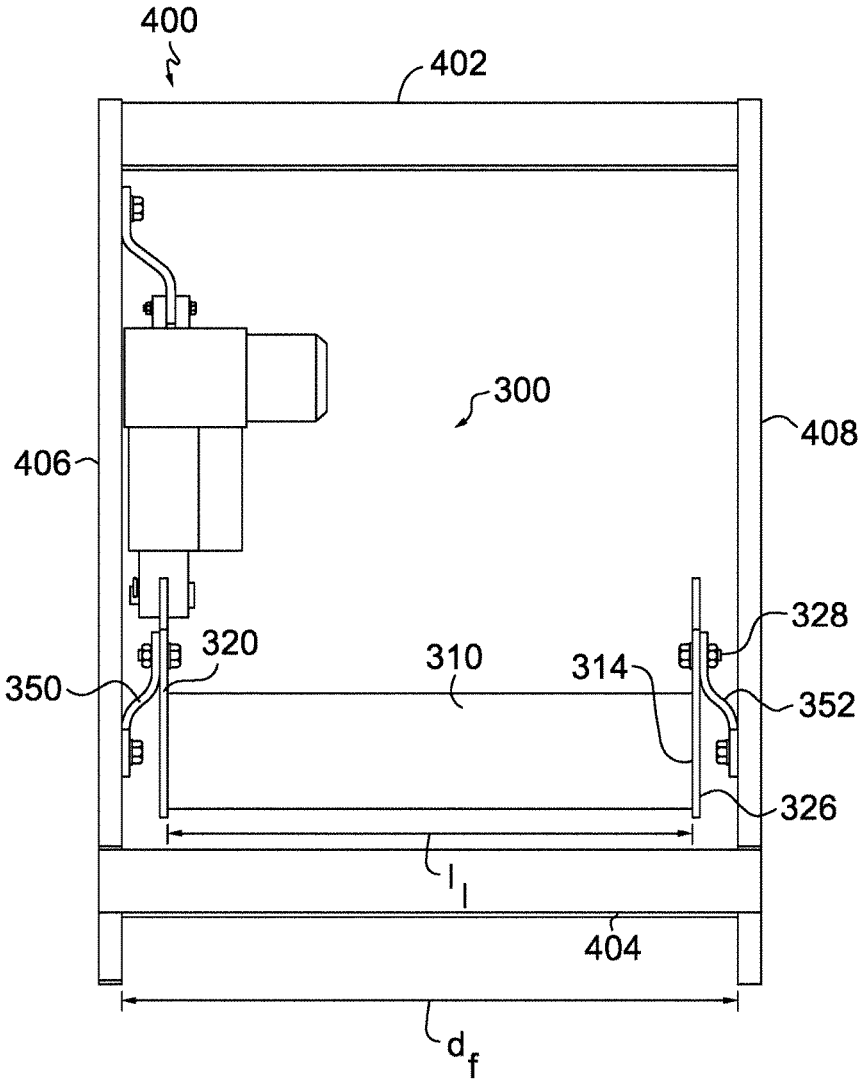
FIG. 5 is a front view of an adjustable lumbar support mechanism showing a lumbar support member coupled, via lumbar support links and lumbar mounting plates, to opposing side frame members of a seat back frame, in accordance with an aspect of the present invention.

As can be seen in FIG. 5, the end 314 of the lumbar support member 310 can be coupled to side frame member 408. For example, the end 314 of the lumbar support member 310 can be coupled, e.g., fixedly coupled, to a lumbar support link 326. In such aspects, the lumbar support link 326 can be coupled, e.g., pivotably coupled, to a lumbar mounting plate 352 at a mounting plate pivot point 328. In certain aspects, the lumbar support link 326, the lumbar support member 310, and the lumbar mounting plate 352 can have any or all of the properties and parameters discussed above with reference to the lumbar support link 320 and the lumbar mounting plate 350 positioned adjacent the side frame 406. Although not shown in the figures, the adjustable lumbar support mechanism 300 can include a second actuating mechanism coupled to the lumbar support link 326 and also mounted onto the side frame member 408. In certain aspects, it is desirable to utilize two actuating mechanisms for large lumbar support members.

Figure 7:
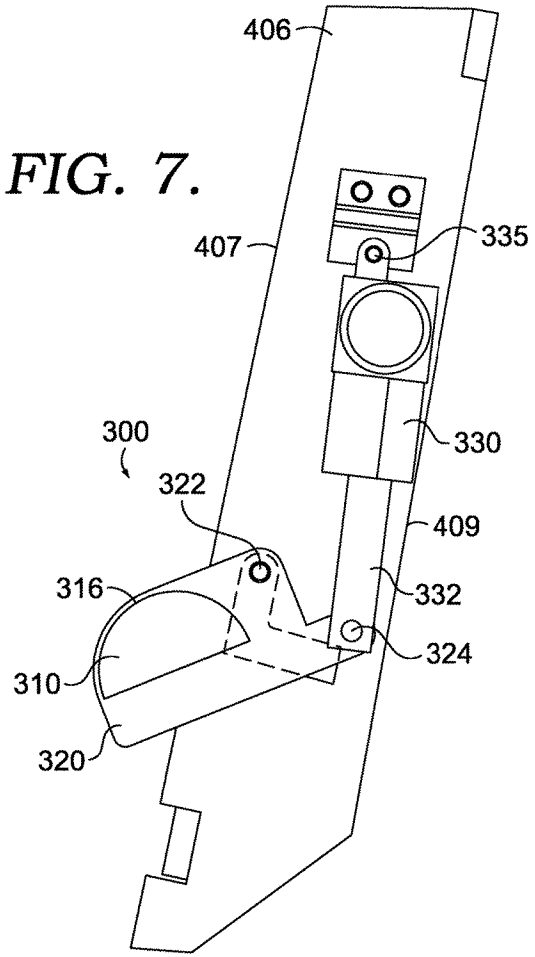
FIG. 7 is a side view of the lumbar support mechanism depicted in FIGS. 3 and 4, but shown in the extended position, in accordance with an aspect of the present invention.
Figure 6:
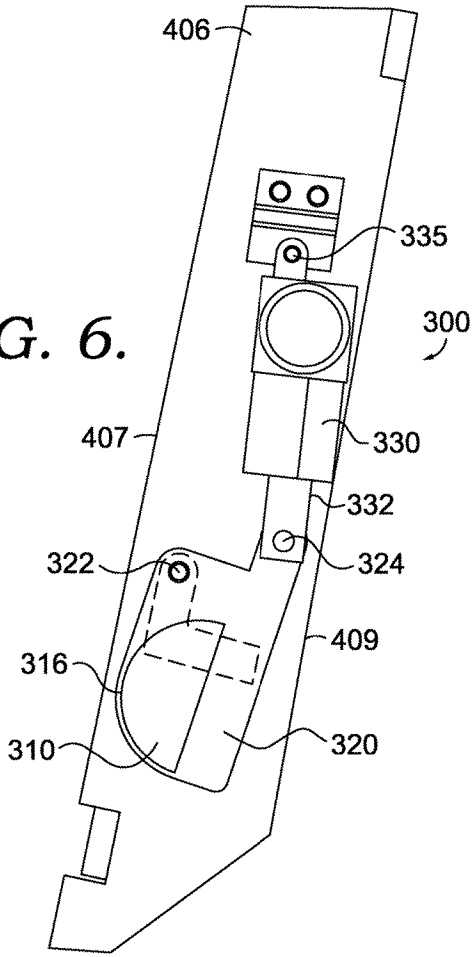
FIG. 6 is a side view of the lumbar support mechanism depicted in FIGS. 3 and 4, in accordance with an aspect of the present invention.

Turning now to FIGS. 6 and 7, the adjustable lumbar support mechanism 300 is depicted from a side view, showing both a retracted configuration (FIG. 6), which is similar to that depicted in FIGS. 3-5, and an extended configuration (FIG. 7). It is appreciated that the adjustable lumbar support mechanism 300 can be moved to any position between the retracted and extended positions depicted in FIGS. 6 and 7, based on the desire of the chair occupant. While not shown in the figures, the material covering the back 120 in the lumbar area 124 accommodates these movements. For example, the fabric or other upholstery components could be elastic, or could be provided with a billowing to allow it to expand and contract.

As can be seen in FIG. 6, when the lumbar support mechanism 300 is in the retracted configuration, the lumbar support member 310 is positioned adjacent the front portion 407 of the side frame member 406, but not extending past the front portion 407 towards the seat 110. In this retracted configuration, the extendable shaft 332 of the actuating mechanism 330 is in a retracted position. Further, in this retracted configuration, the lumbar support member 310 may be providing little to no lumbar support to a chair occupant.

In certain aspects, the final mounting position of the lumbar support member 310 may be modified to provide a retracted configuration where the position of the lumbar support member 310 is chosen for a particular feel in any given application. For example, in an aspect not depicted in the figures, a lumbar support member, such as lumbar support member 310, may protrude past the front portion 407 of the side frame member 406 so that, in the retracted configuration, the lumbar support member 310 provides a little amount of lumbar support to a chair occupant. In such aspects, when in the retracted configuration, the lumbar support member 310 may extend at least about 0.5 inches, at least about 0.75 inches, at least about 1 inch, or at least about 1.5 inches past the front portion 407 of the side frame member 406.

As can be seen in FIG. 7, the extendable shaft 332 of the actuating mechanism 330 is in an extended position, which ultimately caused the lumbar support member 310 to be positioned past the front portion 407 of the side frame member 406 towards the seat 110. This forward location of the lumbar support member 310 is positioned to provide lumbar support to a chair occupant.

As mentioned above, in certain aspects, the position of the lumbar support member 310, the extendable shaft pivot point 324, and/or the mounting plate pivot point 322 are configured to transfer the downward force that can be supplied by the extendable shaft 332 into an adequate force that can move the exterior surface 316 of the lumbar support member 310 up against any upholstery or padding in the back 120 in order to provide lumbar support to a chair occupant. For example, as the extendable shaft 332 extends, a downward force is applied to the extendable shaft pivot point 324 and/or to the mounting plate pivot point 322, which can cause the lumbar support link 320 to pivot or rotate about the extendable shaft pivot point 324 and/or the mounting plate pivot point 322. Further, in such aspects, this pivoting motion of the lumbar support link 320 can cause the lumbar support member 310 and its exterior surface 316 to rotate out and away from the back portion 409 of the side frame member 406 and towards the seat 110.

In one or more aspects, when the extendable shaft 332 is shifting between the retracted configuration and the extended configuration, or from the extended configuration to the retracted configuration, the actuating mechanism 330 may shift laterally towards the back portion 409 or the front portion 407 of the side frame member 406, e.g., by moving about the actuator pivot point 335 and/or the extendable shaft pivot point 324. In such aspects, a lateral movement of the actuating mechanism 330 towards the back portion 409 of the side frame member 406 may provide additional leverage and power to the lumbar support member 310 as it shifts out and away from the back portion 409 of the side frame member 406 and towards the seat 110. Further, in such aspects, a minor lateral shifting of the actuating mechanism 330 may transfer some of the force received by the actuating mechanism 330 during extension or retraction, which may decrease wear of the actuating mechanism 330.

FIG. 8 depicts a detailed view of the lumbar support member 310. The lumbar support member 310 can be formed from a number of different materials, such as wood, plastic, or metal. In certain aspects, the lumbar support member 310 can include one or more mounting holes 311 for rigidly securing the lumbar support link 320 to the side 312. In addition, in one or more aspects, the lumbar support mechanism 310 can include an interior cavity 318. In such aspects, the interior cavity 318 may provide space for the mounting of a vibrating mechanism (not shown).

The length $l_1$ of the lumbar support member 310, defined as the length between the sides 312 and 314, can be any length chosen by one skilled in the art for a particular purpose. In certain aspects, the lumbar support member 310 may extend along a substantial portion of the width of the back 120, which may be advantageous for providing lumbar support across a substantial portion of the back 120. For example, as best seen in FIG. 5, the length $l_l$ of the lumbar support member 310 extends along a substantial distance of the width of the chair or of the distance $d_f$ between the side frame members 406 and 408. In various aspects, the length $l_1$ of the lumbar support member 310 can be at least about 40%, at least about 50%, at least about 60%, at least about 70%, at least about 80%, or at least about 90% of the distance $d_f$ between the side frame members 406 and 408.

As discussed above, when the adjustable lumbar support mechanism 300 is in an extended configuration the external surface 316 of the lumbar support member 310 may contact the upholstery and/or padding and provide lumbar support to a chair occupant. Thus in certain aspects, the shape of the external surface 316 may affect the lumbar support experience by a chair occupant. In one or more aspects, the exterior surface 316 can be curved. In various aspects, a curved exterior surface 316 can provide more directed or pointed lumbar support for a chair occupant, as the curve may be convex. In such aspects, a curved exterior surface 316 having a convex shape in combination with the adjustable extension (and thus position) of the lumbar support member 310, allows for a fully adjustable and customizable lumbar support experience for a chair occupant.

Figure 8A:
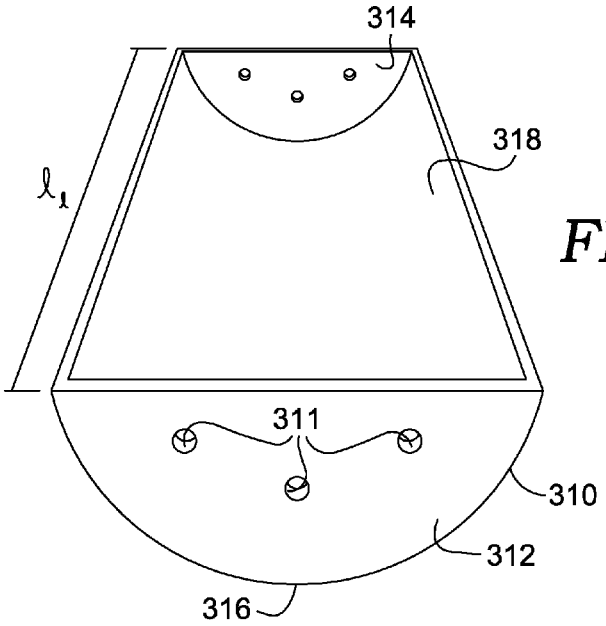
FIG. 8A is a side perspective view of a lumbar support member, in accordance with an aspect of the present invention.
Figure 8B:
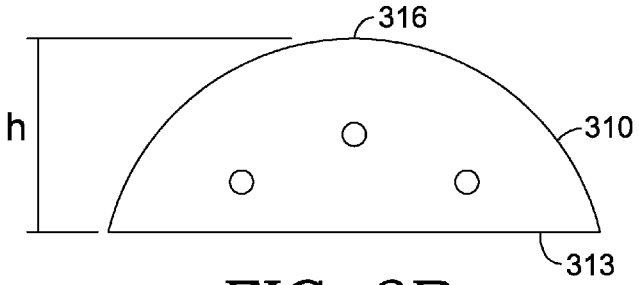
FIG. 8B is a side view of the lumbar support member depicted in FIG. 8A, in accordance with an aspect of the present invention.
Figure 9:
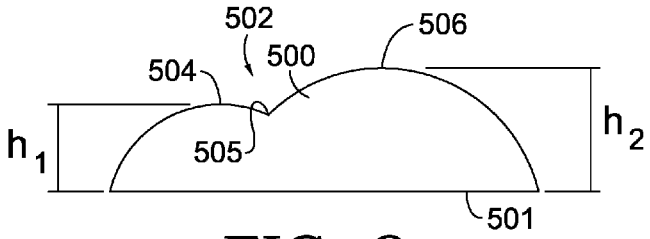
FIG. 9 is a side view of another lumbar support member showing a compound curved exterior surface, in accordance with an aspect of the present invention.

As best seen in FIG. 8B, the exterior surface 316 of the lumbar support member 310 depicted in FIG. 8A is a single arc having a single radius of curvature and a single height h, which is defined as the maximum height of the single arc as measured relative to the base 313 of the lumbar support member 310. In certain aspects, it may be advantageous to provide an exterior surface of a lumbar support member that includes a compound curved exterior surface to provide varying levels of lumbar support to various positions on the back 120 (and ultimately of a chair occupant). For example, as depicted in FIG. 9, the lumbar support member 500 can include an exterior surface 502 having two arcs 504 and 506. In one or more aspects, the lumbar support member 500 can be utilized in the adjustable lumbar support mechanism 300 in place of the lumbar support member 310.

In certain aspects, the distinct arcs 504 and 506 can have varying heights, $h_1$ and $h_2$, respectively. The heights are defined as the maximum height $h_1$ and $h_2$ of the arcs 504 and 506, respectively, as measured relative to the base 501 of the lumbar support member 500. In such aspects, as these arcs 504 and 506 are distinct from one another, it follows that these arcs would have distinct radii of curvature to at least partly define these arcs 504 and 506. It should be understood that the exterior surface 502 can include more than two distinct arcs.

Figure 10:
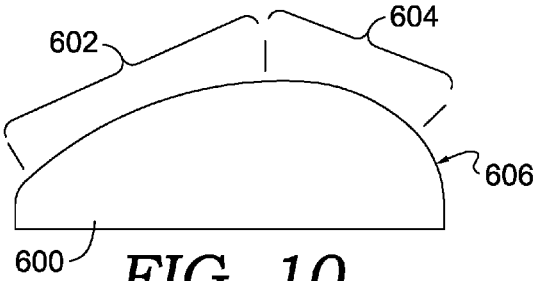
FIG. 10 is a side view of yet another lumbar support member showing a compound curved exterior surface, in accordance with an aspect of the present invention.

In one or more aspects, the lumbar support member can include a complex curved surface that includes more than one arc where the arcs are blended together to provide a smoother exterior surface. For example as depicted in FIG. 10, the lumbar support member 600 can include an exterior surface 606 that includes at least two arcs, e.g., 602 and 604, that are blended together. In the aspect depicted in FIG. 10, the arcs 602 and 604 have distinct radii of curvature and are blended together to provide a continuous exterior surface 606, so as to lack an indent in the surface, such as the indent 505 on the surface 502 of the lumbar support member 500 of FIG. 9. In one or more aspects, the lumbar support member 600 can be utilized in the adjustable lumbar support mechanism 300 in place of the lumbar support member 310.

In various aspects, by utilizing a lumbar support mechanism with a lumbar support member having an exterior surface with a compound curve, such as the lumbar support member exterior surfaces 502 and 606 depicted in FIGS. 9 and 10, respectively, a chair occupant may receive customized and varying levels of lumbar support provided by the varying arc heights of the exterior surface, e.g., the exterior surface 502 or 606. For example, in one aspect, a higher arc height portion of the exterior surface 502 of the lumbar support member 500 in FIG. 9 may provide increased lumbar support for one region of a chair occupant's back relative to the lower arc height portion. In another aspect, the combination and blending of the arcs 602 and 604 of the lumbar support member 600 in FIG. 10 may provide a continuous and increasing amount of lumbar support to varying regions of a chair occupant's back.

Figure 11:
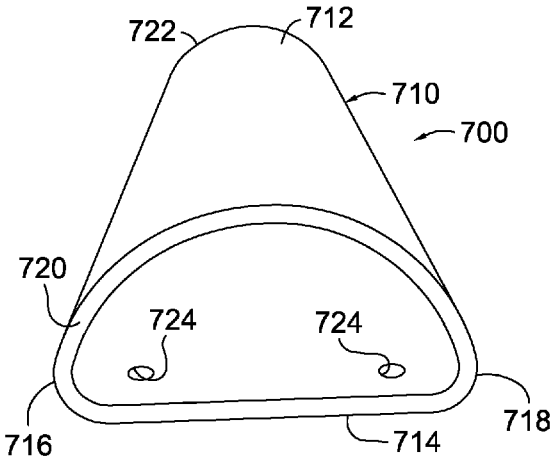
FIG. 11 is a top perspective view of another lumbar support member, in accordance with an aspect of the present invention.

FIG. 11 depicts another aspect of a lumbar support member 700. The lumbar support member 700 of FIG. 11 can be formed from a number of different materials, such as wood, plastic, or metal. In certain aspects, the lumbar support member 700, or any lumbar support members described herein, can be formed using any known fabrication method, such as extrusion or molding of a plastic or other material. In one or more aspects, an extrusion method can be utilized to fabricate lumbar support members, such as the lumbar support member 700, in various lengths.

In one or more aspects, the lumbar support member 700 can have any or all of the properties of the lumbar support members 310, 600, and/or 700 discussed above with reference to FIGS. 3-8B, 9, and 10, respectively. For example, like the lumbar support member 310, the lumbar support member 700 of FIG. 11 includes an exterior surface 710 that can include a front portion 712 and an opposing back portion 714. In certain aspects, the front portion 712 of the exterior surface 710 may be positioned to contact upholstery and/or padding, and to provide lumbar support to a chair occupant. In various aspects, the front portion 712 of the exterior surface 710 can include a curved surface, such as a curved convex surface having a single radius of curvature, such as the lumbar support member 310 depicted in FIGS. 3-8B. In alternative aspects, the front portion 712 of the exterior surface 710 can include a compound curved exterior surface, such as the exterior surfaces 502 and 606, depicted in FIGS. 9 and 10, respectively.

In various aspects, the back portion 714 of the exterior surface 710 of the lumbar support member 700 can be substantially flat. In the same or alternative aspects, the lumbar support member 700 can include rounded corners, e.g., rounded corners 716 and 718 on the end 720, which can form a transition between the back portion 714 and the front portion 712. Rounded corners may also be present on the end 722 opposing the end 720. In certain aspects, the rounded corners, e.g., 716 and 718, may add strength and/or help avoid wear on any inside back fabric or other upholstery in the chair.

In certain aspects, the lumbar support member 700 can include one or more mounting holes, e.g., mounting holes 724, for securing the lumbar support member 700 to one or more lumbar support links. In the same or alternative aspects, one or more lumbar support links may be fixedly coupled to the lumbar support member 700, e.g., on the back portion 714 of the lumbar support member 700.

Figure 12A:
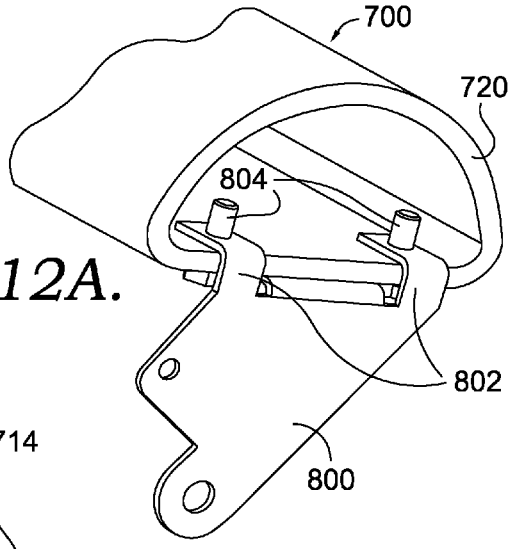
FIG. 12A is a top and side perspective view of a lumbar support link coupled to a lumbar support member, in accordance with an aspect of the present invention.
Figure 12B:
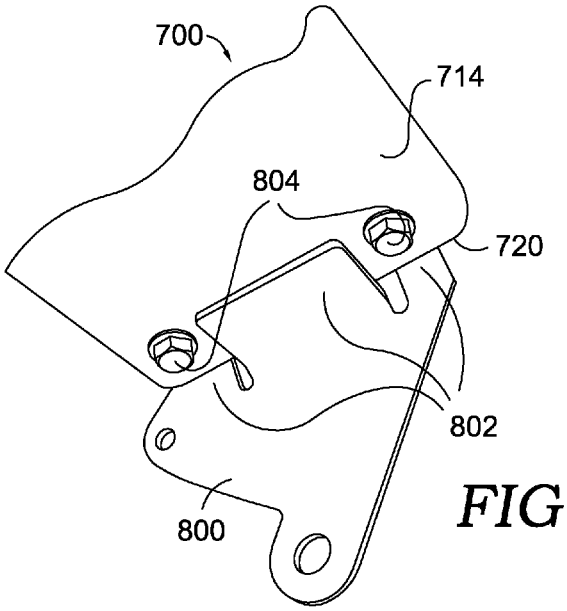
FIG. 12B is a bottom and side perspective view of the lumbar support link and lumbar support member of FIG. 12A, in accordance with an aspect of the present invention.
Figure 14:
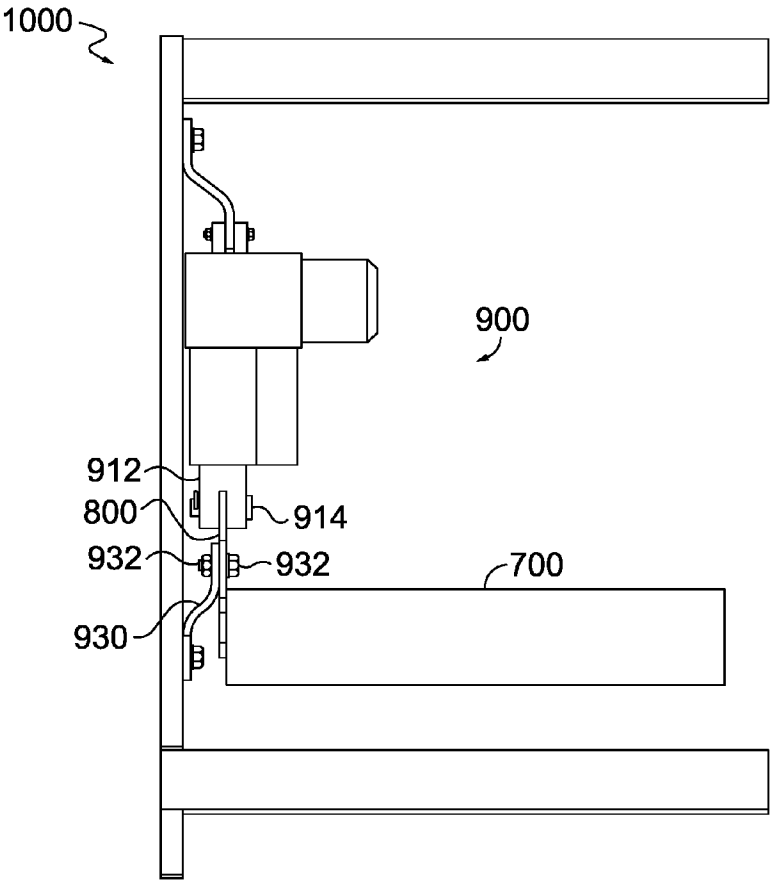
FIG. 14 is a front view of the adjustable lumbar support mechanism depicted in FIG. 13, in accordance with an aspect of the present invention.
Figure 13:
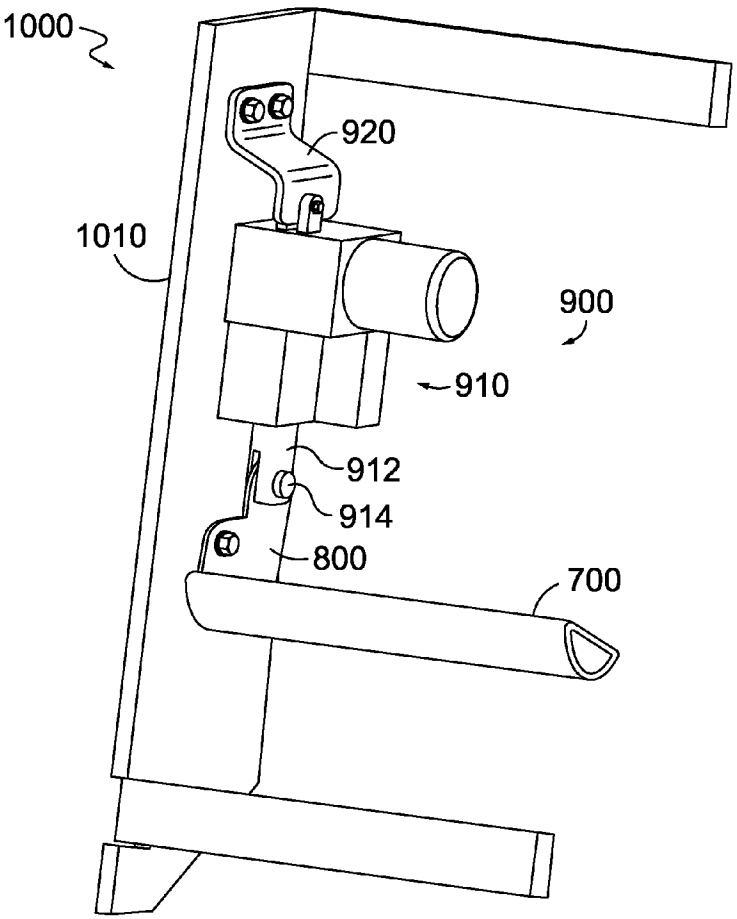
FIG. 13 is a front perspective view of another adjustable lumbar support mechanism in a retracted position and showing portions of the chair back frame, in accordance with an aspect of the present invention.

FIGS. 12A and 12B depict one aspect of a lumbar support link 800 fixedly coupled to the lumbar support member 700. As can be seen in FIGS. 12A and 12B, the lumbar support link 800 is secured to the back portion 714 of the lumbar support member 700, via one or more fasteners 804. The fasteners 804 can be any type of fastener such as bolts, self-tapping bolts, rivets, screws, or any other fastener known to one skilled in the art. In the same or alternative aspects, the lumbar support link 800 can be coupled to the lumbar support member 700 using other conventional techniques, such as welding. The lumbar support link 800 can be made of any type of material typically used in the furniture manufacturing industry, such as a metal, plastic, or wood material. While not depicted in the figures, in certain aspects, two lumbar support links can be secured to the lumbar support member, e.g., with one lumbar support link secured to a position adjacent to each of the opposing ends of the lumbar support member, e.g., the ends 720 and 722 of the lumbar support member 700 of FIG. 11. In such aspects, a lumbar support link can be secured to a position on a lumbar support member that is within 9 inches, 6 inches, or 4 inches from an end of the lumbar support member.

In various aspects, a lumbar support link can be coupled, e.g., fixedly coupled, to a lumbar support member and be, at least partly, located at one end of the lumbar support member. For example, in the aspect depicted in FIGS. 12A and 12B, the lumbar support link 800 is coupled to the back portion 714 of the lumbar support member 700 at a position adjacent the end 720 while, at least a portion of the support tabs 802 are located at the end 720 of the lumbar support member 700. In such aspects, the support tabs 802 of the lumbar support link 800 can be integral with the lumbar support link 800 or can be secured to the lumbar support link 800. As can be seen in FIGS. 12A and 12B, the support tabs 802 can facilitate coupling the lumbar support member 700 to the lumbar support link 800, via the fasteners 804 and through physical interaction with the back portion 714 of the lumbar support member 700.

Turning now to FIGS. 13-16, the lumbar support member 700 and lumbar support link 800 of FIGS. 11-12B are shown in an adjustable lumbar support mechanism 900. In various aspects, the adjustable lumbar support mechanism 900 can have any or all of the properties and parameters of the lumbar support mechanism 300 described above with reference to FIGS. 3-7. For example, the adjustable lumbar support mechanism 900 can include an actuating mechanism 910 coupled, via an actuator mounting plate 920, to a side frame member 1010 of a seat back frame 1000.

Additionally, like in the adjustable lumbar support mechanism 300 described above, the adjustable lumbar support mechanism 900 can include a lumbar support mounting plate 930 that is pivotably coupled, at a mounting plate pivot point 932, to the lumbar support link 800. The mounting plate 930 can also be fixedly coupled to the side frame member 1010.

Figure 16:
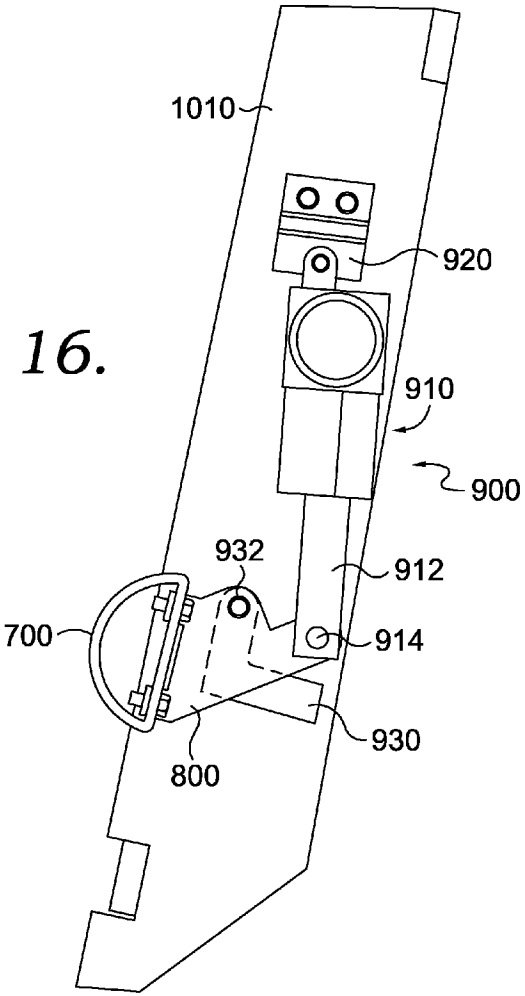
FIG. 16 is a side view of a lumbar support mechanism that includes the lumbar support link and lumbar support member of FIGS. 12A and 12B, but shown in an extended position, in accordance with an aspect of the present invention.
Figure 15:
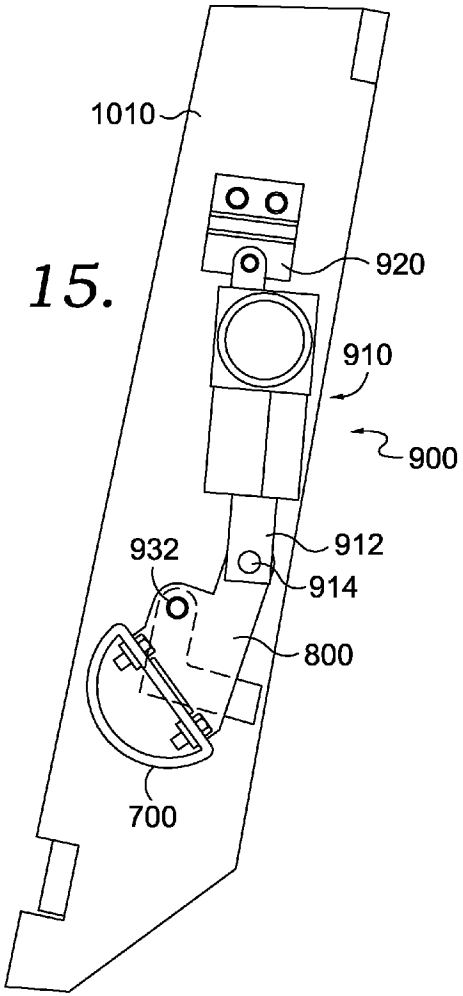
FIG. 15 is a side view of a lumbar support mechanism that includes the lumbar support link and lumbar support member of FIGS. 12A and 12B, in accordance with an aspect of the present invention.

In various aspects, an extendable shaft 912 of the actuating mechanism 910 can be pivotably coupled to the lumbar support link 800 at a pivot point 914. As described above with reference to the adjustable lumbar support mechanism 300, when the extendable shaft 912 is in a retracted configuration the lumbar support member 700 is positioned for minimal, if any, lumbar support for a chair occupant. As can be seen in FIG. 16, when the extendable shaft 912 is in an extended configuration, the lumbar support link 800 has pivoted, at least about the pivot point 932 to move the lumbar support member 700 out and away from the seat back frame 1000 and side frame member 1010 to provide lumbar support for a chair occupant.

In certain aspects, as can be best seen in FIG. 16, when the mechanism 900 is in the extended configuration, the front portion 712 of the exterior surface 710 of the lumbar support member 700 is positioned to be directly facing the back of the upholstery or the back of a chair occupant. This is different than the lumbar support member 310 depicted in FIG. 7, where the exterior surface 316 of the lumbar support member 310 is oriented at least partly upward. It is appreciated that both these orientations of the lumbar support members 310 and 700 can provide varying levels of lumbar support and either orientation, or various other orientations, of the lumbar support members, is contemplated by the disclosure herein.

Many different arrangements of the various components depicted, as well as components not shown, are possible without departing from the scope of the claims below. Aspects of our technology have been described with the intent to be illustrative rather than restrictive. Alternative aspects will become apparent to readers of this disclosure after and because of reading it. Alternative means of implementing the aforementioned can be completed without departing from the scope of the claims below. Certain features and sub-combinations are of utility and may be employed without reference to other features and sub-combinations and are contemplated within the scope of the claims.

It will be seen from the foregoing that this invention is one well adapted to attain the ends and objects set forth above, and to attain other advantages, which are obvious and inherent in the device. It will be appreciated by persons skilled in the art that the present invention is not limited to what has been particularly shown and described herein above. Rather, all matter herein set forth or shown in the accompanying drawings is to be interpreted as illustrative and not limiting.

What is claimed is:

1. An adjustable lumbar support mechanism for providing lumbar support in a seating unit having a seat and a seat back having a back frame, the back frame having opposing first and second side frame members, and opposing top and bottom frame members, the bottom frame member being positioned adjacent the seat, the adjustable lumbar support mechanism comprising:

a lumbar support member, the lumbar support member having opposing first and second ends and an exterior surface extending between the first and second ends, wherein the exterior surface has a front portion and an opposing back portion;

at least one lumbar support link fixedly coupled to the lumbar support member;

at least one lumbar mounting plate pivotably coupled to the at least one lumbar support link at a mounting plate pivot point; and one or more actuating mechanisms, wherein each of the one or more actuating mechanisms comprises an extendable shaft pivotably coupled to the at least one lumbar support link at an extendable shaft pivot point, wherein when the extendable shaft is shifted from a retracted position to an extended position; 1) the at least one lumbar support link is configured to rotate relative to the at least one lumbar mounting plate thereby positioning at least the front portion of the exterior surface of the lumbar support member away from the back frame and towards the seat; and 2) the extendable shaft pivot point shifts towards the bottom frame member and past the mounting plate pivot point.

2. The adjustable lumbar support mechanism of claim 1, wherein the at least one lumbar support link is configured to rotate relative to the at least one lumbar mounting plate about the mounting plate pivot point.

3. The adjustable lumbar support mechanism of claim 2, wherein the at least one lumbar support link is further configured to rotate relative to the at least one lumbar mounting plate about the extendable shaft pivot point such that when the extendable shaft is shifted from the retracted position to the extended position, the at least one lumbar support link rotates about both the extendable shaft pivot point and the mounting plate pivot point.

4. The adjustable lumbar support mechanism of claim 1, wherein the at least one lumbar support link is fixedly coupled to the back portion of the exterior surface of the lumbar support member.

5. The adjustable lumbar support mechanism of claim 4, wherein at least a portion of the at least one lumbar support link is located at one of the first and second ends of the lumbar support member.

6. The adjustable lumbar support mechanism of claim 1, wherein the at least one lumbar support link comprises a first and second lumbar support link, wherein the first lumbar support link is fixedly coupled to the back portion of the exterior surface of the lumbar support member at a first position on the back portion, wherein the second lumbar support link is fixedly coupled to the back portion of the exterior surface of the lumbar support member at a second position on the back portion, wherein the first position and second position are spaced apart from one another, wherein at least a portion of the first lumbar support link is located at the first end of the lumbar support member, and wherein at least a portion of the second lumbar support link is located at the second end of the lumbar support member.

7. The adjustable lumbar support mechanism of claim 1, wherein the front portion of the exterior surface of the lumbar support member comprises a curved surface.

8. The adjustable lumbar support mechanism of claim 7, wherein the curved surface is a convex surface facing away from the back frame when the extendable shaft is in the extended position.

9. The adjustable lumbar support mechanism of claim 7, wherein the curved surface is a complex curved surface having at least two arcs with distinct radii of curvature.

10. The adjustable lumbar support mechanism of claim 1, wherein a length $l_l$ between the first and second ends of the lumbar support member is at least about 60% of a distance $d_f$ between the first and second side frame members of the back frame.

11. A residential furniture seating unit, comprising:

a seat spaced above a surface on which the seating unit rests;

a seat back extending upwardly from the seat adjacent a rear portion of the seat, the seat back including a seat back frame having opposing first and second side frame members, and opposing top and bottom frame members, the bottom frame member being positioned adjacent the seat; and an adjustable lumbar support mechanism, the adjustable lumbar support mechanism comprising:

a lumbar support member, the lumbar support member having opposing first and second ends and an exterior surface extending between the first and second ends, wherein the exterior surface has a front portion and an opposing back portion;

at least one lumbar support link fixedly coupled to the lumbar support member;

at least one lumbar mounting plate pivotably coupled to the at least one lumbar support link at a mounting plate pivot point; and one or more actuating mechanisms, wherein each of the one or more actuating mechanisms comprises an extendable shaft pivotably coupled to the at least one lumbar support link at an extendable shaft pivot point, wherein when the extendable shaft is shifted from a retracted position to an extended position: 1) the at least one lumbar support link is configured to rotate relative to the at least one lumbar mounting plate thereby positioning at least the front portion of the exterior surface of the lumbar support member away from the back frame and towards the seat; and 2) the extendable shaft pivot point shifts towards the bottom frame member and past the mounting plate pivot point.

12. The residential furniture seating unit of claim 11, wherein the at least one lumbar support link is configured to rotate relative to the at least one lumbar mounting plate about the mounting plate pivot point.

13. The residential furniture seating unit of claim 12, wherein the at least one lumbar support link is further configured to rotate relative to the at least one lumbar mounting plate about the extendable shaft pivot point such that when the extendable shaft is shifted from the retracted position to the extended position, the at least one lumbar support link rotates about both the extendable shaft pivot point and the mounting plate pivot point.

14. The residential furniture seating unit of claim 11, wherein the front portion of the exterior surface of the lumbar support member comprises a curved surface.

15. The residential furniture seating unit of claim 14, wherein the curved surface is a convex surface facing away from the back frame.

16. The residential furniture seating unit of claim 14, wherein the curved surface is a complex curved surface having at least two arcs with distinct radii of curvature.

17. The residential furniture seating unit of claim 11, wherein a length $l_l$ between the first and second ends of the lumbar support member is at least about 60% of a distance $d_f$ between the first and second side frame members of the back frame.

18. The adjustable lumbar support mechanism of claim 11, wherein the at least one lumbar support link is fixedly coupled to the back portion of the exterior surface of the lumbar support member.

19. The adjustable lumbar support mechanism of claim 18, wherein at least a portion of the at least one lumbar support link is located at one of the first and second ends of the lumbar support member.

20. The adjustable lumbar support mechanism of claim 18, wherein the at least one lumbar support link comprises a first and second lumbar support link, wherein the first lumbar support link is fixedly coupled to the back portion of the exterior surface of the lumbar support member at a first position on the back portion, wherein the second lumbar support link is fixedly coupled to the back portion of the exterior surface of the lumbar support member at a second position on the back portion, wherein the first position and second position are spaced apart from one another, wherein at least a portion of the first lumbar support link is located at the first end of the lumbar support member, and wherein at least a portion of the second lumbar support link is located at the second end of the lumbar support member.

* * * * *